US007164084B2

(12) United States Patent
Studer

(10) Patent No.: US 7,164,084 B2
(45) Date of Patent: Jan. 16, 2007

(54) THREE-CONDUCTOR CABLE

(75) Inventor: Christoph Studer, Gretzenbach (CH)

(73) Assignee: Studer Draht - und Kabelwerk AG, Daniken (CH)

( * ) Notice: Subject to any disclaimer, the term of this patent is extended or adjusted under 35 U.S.C. 154(b) by 0 days.

(21) Appl. No.: 10/509,393

(22) PCT Filed: Apr. 2, 2003

(86) PCT No.: PCT/CH03/00211

§ 371 (c)(1),
(2), (4) Date: Mar. 22, 2005

(87) PCT Pub. No.: WO03/083879

PCT Pub. Date: Oct. 9, 2003

(65) Prior Publication Data

US 2005/0167150 A1 Aug. 4, 2005

(30) Foreign Application Priority Data

Apr. 3, 2002 (CH) ..... 0551/02

(51) Int. Cl.
*H01B 7/00* (2006.01)

(52) U.S. Cl. ..... 174/113 R; 174/110 R; 174/115

(58) Field of Classification Search ..... 174/113 R, 174/110 R, 115
See application file for complete search history.

(56) References Cited

U.S. PATENT DOCUMENTS 3,261,907 A 7/1966 Morrison
3,772,454 A * 11/1973 Donecker et al. ..... 174/113 R
4,317,002 A 2/1982 Spicer
4,358,636 A * 11/1982 Ijff et al. ..... 174/113 R

FOREIGN PATENT DOCUMENTS

EP 577233 A1 * 1/1994
WO 01 04911 1/2001

OTHER PUBLICATIONS

English Abstract for EP 577233 A1□□.*

* cited by examiner

*Primary Examiner*—Jinhee Lee
(74) *Attorney, Agent, or Firm*—Wenderoth, Lind & Ponack, L.L.P.

(57) ABSTRACT

A three-conductor cable (10) including three stranded electric cables (1), each having a core that has a current conductor (2) and a neutral and/or return conductor. Each individual cable (1) is essentially characterized in that the neutral and/or return conductor is configured from a number of individual conductors (4), distributed concentrically around the current conductor (2), that an insulating sheath (3) is provided between the current conductor (2) an the distributed individual conductors (4) of the neutral and/or return conductor and that a protective jacket covers the neutral and/or return conductor.

5 Claims, 1 Drawing Sheet

THREE-CONDUCTOR CABLE

BACKGROUND OF THE INVENTION

1. Technical Field of the Invention

The invention concerns a three-conductor cable for power transmission at a frequency of at least 50 Hz, preferably at least 100 Hz, for example 400 Hz.

In the 400 Hz range, what are referred to as high-frequency power transmission cables are used. They are required for example on aircraft and the like, in order to connect them during stationary periods to a fixed network or a mobile power supply. Because the aircraft's on-board electronics are highly sensitive to current fluctuations, the cable must not generate any damaging asymmetrical voltage drops.

Another domain of application is engine technology. Thus, for example, high-frequency power transmission cables can also be used to power motors for spindle drives (induction/synchronous motors) or brushless DC motors.

2. Description of the Related Art

Known high-frequency cables for frequencies of 400 Hz and above consist of four intertwined component conductors, consisting of three phase conductors and a neutral and/or return line. In this construction, two phase conductors lie adjacent to the neutral and/or return line respectively. Between these two in turn lies the third phase conductor. This asymmetry results in a detrimental inductive voltage drop, which takes on great significance especially in cables which are used at the higher frequency range.

Asymmetrical electrical fields also arise due to the geometry of this known four-conductor cable, which can propagate interference to the immediate environment. The geometry of four stranded single-conductor cables also means that the mechanical position of the arrangement is not clearly defined, and this must normally be resolved by a central element.

However, there are also high-frequency power transmission cables with a symmetrical cable arrangement. These cables do not have the geometry-induced disadvantages of the aforementioned four-conductor cable. In these, the phase conductors run in pairs, stranded about the centrally-disposed neutral and/or return line. This creates a symmetrical arrangement with the neutral and/or return line in the center and six phase conductors stranded symmetrically about this. In this arrangement, two opposing phase conductors are connected with each other. In this construction the return line takes up half the cross-section of the phase conductor. This is a disadvantage when there is an asymmetrical load, as often occurs with wide-body aircraft. Although in operational status the construction has relatively low inductance, it is expensive and usually fairly inflexible. It also requires insulation of two parallel three-phase systems, which means additional expense for high-quality insulation material. Moreover, with this cable the two associated phase conductors must be combined before or inside the plug.

This second type of high-frequency power transmission cable has the disadvantages of being complicated and relatively expensive manufacture. Furthermore these cables have a smaller surface over which the heat losses building up internally can be dissipated into the environment.

SUMMARY OF THE INVENTION

The invention is thus based on the problem of creating an electrical cable for power transmission at a frequency of at least 50 Hz and in particular a highfrequency power transmission cable which does not display the aforementioned disadvantages, whereby the latter especially should combine the advantages of a symmetrical arrangement with the flexibility and simplicity of twisted singleconductor construction and, with the same load capacity and operational safety, has a similar diameter to known four-conductor high-frequency cables.

The three-conductor cable according to the present invention is intended, for example, for power transmission in the higher frequency range, from 400 Hz upwards, and has a symmetrical construction of three intertwined electrical cables. Each of the three electrical cables is essentially characterized in that it consists of a phase conductor, an insulation, and a concentrically-running neutral and/or return line. Embedded in the concentrically-running neutral and/or return line are dummy and control conductors, whereby an external protective sheath is additionally applied on top of these and the neutral and/or return line.

The three-conductor cable thus contains one concentric, external neutral and/or return line per phase conductor, which, however, in completely symmetrical operation practically never has to be used. Only a small inductance results from the geometrical structure, and this has a positive effect on the voltage drop.

BRIEF DESCRIPTION OF THE DRAWINGS

Next, an embodiment of the invention will be described with the aid of the drawings, in which.

DETAILED DESCRIPTION OF A PREFERRED EMBODIMENT

Figure 1:
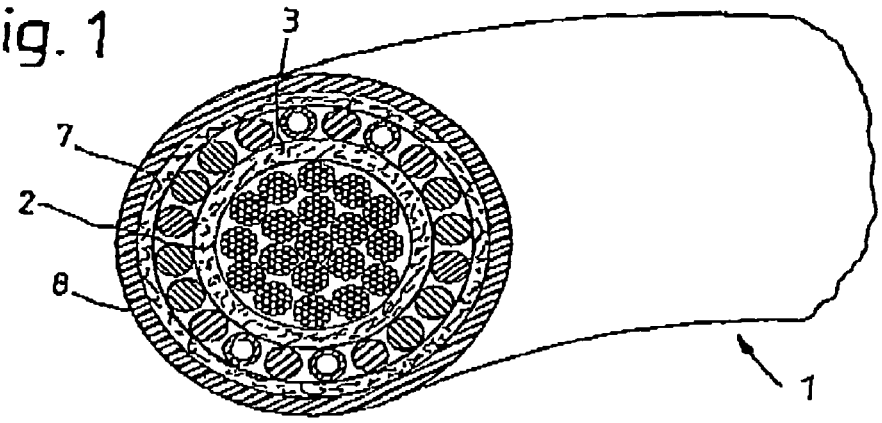
FIG. 1: is a perspective view of an electrical cable.
Figure 2:
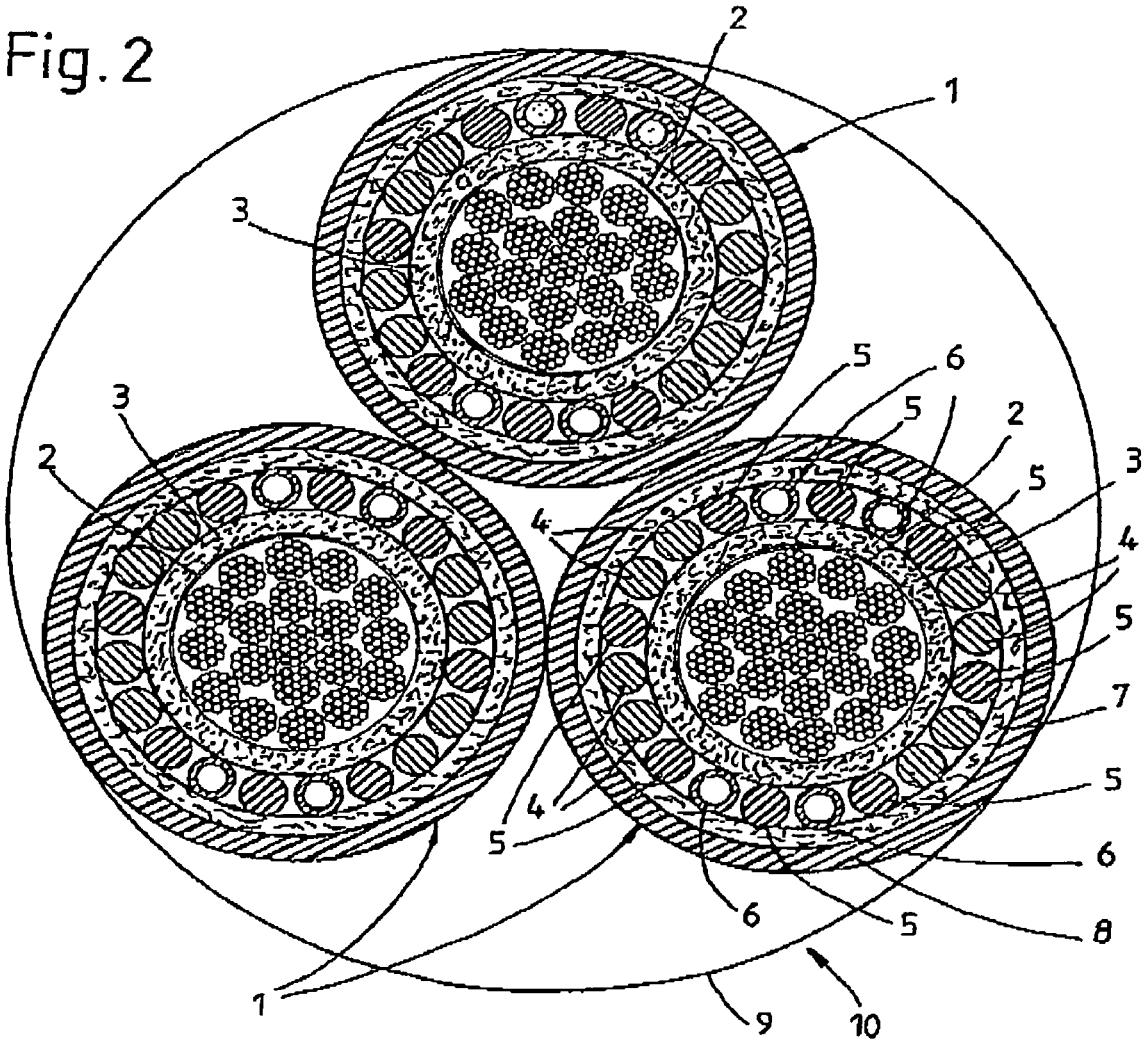
FIG. 2: is a cross-section through a three-conductor cable according to the invention with three intertwined electrical cables in accordance with FIG. 1.

The electrical cable shown in FIG. 1 separately and in FIG. 2 intertwined with identical cables and referred to as a whole by the number 1 has a conductor, namely an inner conductor 2 with several intertwined wires.

The inner conductor 2 is encased by a protective sheath 3, preferably made of plastic, hereinafter also referred to as insulation.

Embedded in the concentrically-running neutral and/or return line, formed for example by eight component conductors 4, are dummy conductors 5 and control conductors 6 which for their part are coupled for control, monitoring, measurement and command purposes.

Over the component conductors 4 of the neutral and/or return line, the dummy conductors 6 and the control conductors 6 is applied a fleece band 7 and over that a protective sheath 8, which is preferably made from plastic.

The following details which relate to the diameter of the various layers are given by way of example and relate to an electrical cable which has an inner conductor cross-section of approx. 50 $mm^2$ and is intended for power transmission at a frequency of 400 Hz. Obviously with a larger current conductor cross-section or different frequency ranges, the various cross-sections can increase or decrease accordingly.

The protective sheath 3 surrounding the inner conductor 2 is some 0.2 to 1.4 mm thick and consists for example of a plastic band, for example made of polyester, which winds about the inner conductor 2 with an overlap of for example 20 to 30% of the band width, and also an extruded plastic layer.

Disposed around the insulation 3 are the neutral and/or return line, the control conductors 6 and the dummy conductors 5, symmetrically stranded. The eight component conductors 4 forming the return line consist for preference of Cu wires with a cross-section of some 2.5 $mm^2$ each.

The fleece band 7 is wound around the stranding consisting of the component conductors 4, the neutral and/or return line, the control conductors 8 and the dummy conductors 5, with an overlap of for example 20 to 30% of the band width, whereby this preferably has a wall thickness of some 0.05 to 0.2 mm.

The sheath 8 encasing the fleece band 7 consists of known material and has a wall thickness of for example 1.5 to 5 mm.

The three-conductor cable shown in FIG. 2 and referred to as a whole as 10 has three intertwined electrical cables 1 of the aforementioned type. The three electrical cables 1, which are intertwined with each other can, in a special embodiment of the invention, however, additionally be held together by a sheath encasing them, for example in the form of a bandage or tube, which secures the electrical cables 1 against any axial displacement.

The three-conductor cable according to the invention has the advantages over the known high-frequency cables in that with the same load capacity, it has an absolutely symmetrical voltage drop on all three conductors, which proves smaller than in ordinary cables. At the same time, a smaller mechanical bending moment is achieved due to the construction according to the invention and thanks to the simple structure, the connection layout in the connection plug is simple to realize. Furthermore, no central dummy conductor in addition to the defined stranding is necessary, so that the cable thereby becomes lighter and more flexible.

Moreover, as the result of the construction according to the present invention, personal safety is increased. Before the phase conductor can be touched by being damaged with a metallic object, namely the neutral conductor carrying the earth potential must be damaged. The result of this is that in case of damage, the phase with the earth potential is short-circuited, before it can be touched live.

Compared with known four-conductor cables, the three-conductor cable has additional advantages such as a clear separation of control conductors and phase conductors, improved EMC behavior and more stable distribution. Compared with known cables with a symmetrical cable arrangement, the three-conductor cable according to the present invention has the further advantage of improved heat radiation.

The three-conductor cable according to the present invention can be used in the frequency range of 50 Hz and over. Its symmetrical construction with relatively large cross-section of the return line offers optimal conditions for connections of asymmetrical loads. The symmetrical construction also offers striking advantages for flexible connections between UPS devices and data processing equipment, radar stations, and transmission equipment, inverter-motor connections with higher EMC requirements, etc.

It should be pointed out here that the electrical cable described with the aid of FIG. 1 and also the three-conductor cable shown in FIG. 2 represent only a selection of a number of potential embodiments of the invention and can be modified in various respects.

Thus for example there is the option of embedding the control conductors, not in the neutral and/or return line but in the respective phase conductor, as is the case in fact in known high-frequency cables. Also, the symmetrically distributed component conductors 4, instead of being stranded, can be disposed in meandering form about the phase conductor and the protective sheath 3 could consist of just one extruded plastic layer.

The invention claimed is:

1. A three-conductor cable comprising three intertwined electrical cables, each of said intertwined electrical cables comprising:

a conductor having a current lead formed of wire;

a neutral or return line formed by a number of component conductors that are distributed concentrically about the current lead;

a protective insulation disposed between the current lead and the component conductors of the neutral or return line;

a protective sheath surrounding the neutral or return line, wherein the protective insulation is approximately 0.2 to 1.4 mm thick; and a plurality of dummy conductors and a plurality of control conductors for control, monitoring, measurement and command purposes, wherein the dummy conductors and the control conductors are embedded in the neutral or return line, which is formed by the component conductors;

further comprising a fleece tape disposed over the neutral or return line, and the protective sheath disposed over the fleece tape.

2. The three-conductor cable as claimed in claim 1, wherein the protective sheath is formed of plastic.

3. The three-conductor cable as claimed in claim 1, wherein the number of component conductors is eight.

4. The three-conductor cable as claimed in claim 1, wherein the three intertwined electrical cables are encased by an outer sheath.

5. A high-frequency electrical cable for power transmission at a frequency of a least 50 MHz comprising a three-conductor cable having three intertwined electrical cables, each of said intertwined electrical cables comprising:

a conductor having a current lead formed of wire;

a neutral or return line formed by a number of component conductors that are distributed concentrically about the current lead;

a protective insulation layer disposed between the current lead and the distributed component conductors of the neutral or return line;

a protective sheath applied on the neutral or return line, wherein the protective insulation layer surrounding the inner conductor is approximately 0.2 to 1.4 mm thick; and a plurality of dummy conductors and a plurality of control conductors for control, monitoring, measurement and command purposes, wherein the dummy conductors and the control conductors are embedded in the neutral or return line, which is formed by the component conductors;

further comprising a fleece tape disposed over the neutral or return line, and the protective sheath disposed over the fleece tape.

* * * * *